US007382329B2

(12) United States Patent
Kim

(10) Patent No.: US 7,382,329 B2
(45) Date of Patent: Jun. 3, 2008

(54) VARIABLE BEAM CONTROLLING ANTENNA FOR A MOBILE COMMUNICATION BASE STATION

(76) Inventor: Duk Yong Kim, 7291 Garden Grove Blvd., Suite # L, Garden Grove, CA (US) 92841

( * ) Notice: Subject to any disclaimer, the term of this patent is extended or adjusted under 35 U.S.C. 154(b) by 72 days.

(21) Appl. No.: 11/431,856

(22) Filed: May 11, 2006

(65) Prior Publication Data

US 2007/0262911 A1 Nov. 15, 2007

(51) Int. Cl.
*H01Q 3/00* (2006.01)

(52) U.S. Cl. ..... 343/757

(58) Field of Classification Search ..... 343/757, 343/765–766, 872, 882, 754
See application file for complete search history.

(56) References Cited

U.S. PATENT DOCUMENTS 5,283,590 A * 2/1994 Wong ..... 343/754
6,019,703 A * 2/2000 Black et al. ..... 477/168
6,417,814 B1 * 7/2002 Hupka et al. ..... 343/757
7,145,515 B1 * 12/2006 Kim ..... 343/766
7,245,262 B2 * 7/2007 Kim ..... 343/766

* cited by examiner

*Primary Examiner*—Huedung Mancuso
(74) *Attorney, Agent, or Firm*—Albert O. Cota

(57) ABSTRACT

A variable beam controlling antenna for a mobile communication base station having at least two radiator portions that are arranged vertically, with each portion having a reflector with at least one radiator installed therein. At least one force generator provides rotational force when applied on external control signal, and a force transfer portion transfers the rotational force generated from the force generator to at least one reflector, thus rotating the at least one reflector. The variable beam controlling antenna can be fabricated at a low cost and allows for easy automatic optimization, which is required for a mobile communication wireless network since it is configured to be a one-column antenna capable of controlling a horizontal beam width. Although conventionally many kinds of antennas with different beam widths are needed for base station sectors, the single antenna can easily change its beam width.

4 Claims, 11 Drawing Sheets

VARIABLE BEAM CONTROLLING ANTENNA FOR A MOBILE COMMUNICATION BASE STATION

TECHNICAL FIELD

The invention generally pertains to antennas for mobile communication base stations, and in particular, a variable beam controlling antenna that is configured to control the variable down tilting, horizontal steering and horizontal beam width of the antenna.

BACKGROUND ART

While fixed antennas are typically used as base station antennas in mobile communication systems, vertical variable down-tilting antennas are also used due to a reduction in labor and optimization of coverage benefits. A vertical variable down-tilting antenna can adjust phase at a vertical array by use of a phase shifter, thereby controlling an antenna beam vertically in accordance with the coverage of a cell site.

In recent years, a technique for horizontally steering antenna beams in the directions of sectors according to the distribution of subscribers within a cell site has been developed. There are two means of providing horizontal control of antenna beams: electrical horizontal beam control through electrical phase control of a signal provided to each column, and mechanical beam control that utilizes horizontal steering using a one-column antenna.

The mechanical beam control is preferred since its size and has the electrical advantage of not causing horizontal side lobe. The vertical beam control is performed by a separate operation and thus it is applicable to both vertical tilting and horizontal steering.

The use of an antenna equipped with the two-dimensional control functions of vertical tilting and horizontal steering creates dynamic network optimization according to a wireless network's capacity and coverage requirements. However, problems may occur in actual cell sites when only two-dimensional beam antennas are utilized. A typical sector configuration, i.e., a three 120-degree sector configuration, when horizontal steering direction is adjusted according to subscriber distribution, shadowing can be produced or an overlapped zone increase between sectors.

Accordingly, for adjustment of the horizontal steering direction, altering the horizontal beam width is required to suppress the shadowing and minimize the overlap zone.

It has been difficult, though, to provide an easy and low-cost method of altering the horizontal beam width. Typically, there are three methods available to change the horizontal beam width.

The first consists of adjusting the angle and length of a reflector in a one-column antenna. It is a classic method used for a vertical polarization antenna.

An example of the first method is disclosed in "Ref. Mobile Antenna System Handbook, K. Fujimoto and J. R James pp. 133-134". However, distinctive drawbacks of the first horizontal beam width changing method are that an antenna must be very large due to a valid reflector length, and the isolation and cross polarization of a dual polarization antenna widely used at preset are degraded.

The second method to change horizontal beam width is a typical antenna technique in which a three or more-column antenna is horizontally implemented in order to change the antenna beam width through control of the distribution ratio and phase of each column. An example of the second method found in a Korean Patent Application No. 2003-7000418 entitled "Cellular Antenna", filed by "Andrew Corporation". This second method is not viable for commercialization in a mobile communication base station.

While a predetermined beam width is realized with the use of a one-column or two-column antenna in a typical mobile communication base station, the second method requires at least a three-column antenna. Therefore, antenna size and cost are increased. Moreover, to change the distribution ratio and phase, expensive and high-loss parts are used, thereby decreasing antenna gain. Therefore, an antenna employing this method is used for military purposes.

The third method utilizes a two- or more-column antenna which is implemented horizontally, and the horizontal steering directions of the reflectors in the columns are controlled to cross each other mechanically, thereby controlling the beam width. In practice, it is hard to form a typical antenna beam suitable for a sector with this kind of antenna. An example of the third method is found in a Korean Patent Application No. 2003-95761 entitled "Apparatus for Controlling Antenna Beam in a Mobile Communication Base Station", filed by the present applicant. When a wide beam width is obtained by changing the antenna beam width, ripples are created in the forward direction of the antenna and a radiation pattern other than "Sharp Roll-off" increases an overlap zone between sectors. This third method also requires at least a two-column antenna.

DISCLOSURE OF THE INVENTION

The primary object of the invention is to provide a variable beam controlling antenna that:

- is particularly suitable for use in a mobile communication base station,
- is configured as a one-column antenna,
- controls the variable down tilting, horizontal steering and the horizontal beam width of the antenna, and
- is cost effective from both a manufacturer's and consumer's point of view.

The above objects are achieved by providing a variable beam controlling antenna having at least two radiator portions that are arranged vertically to have the same rotational center. Each portion also has a reflector with at least one radiator installed therein. At least one force generator provides rotational force provided by an external control signal, and a force transfer means for transferring the rotational force generated from the force generator to at least one reflector, thus rotating the at least one reflector.

Preferably, the antenna further includes a second force generator for providing rotational force to rotate the entire radiator portions, and a second force transfer means for transferring the rotational force generated from the second force generator to the radiators, thus rotating all of the radiators.

BEST MODE FOR CARRYING OUT THE INVENTION

The preferred embodiments of the present invention are described below in combination with the attached figures. Details such as specific components are also described in the following description, and it is obvious to those skilled in the art that the details are provided for comprehensive understanding of the present invention and thus variations or modifications can be made to them within the scope of the present invention.

Figure 1:
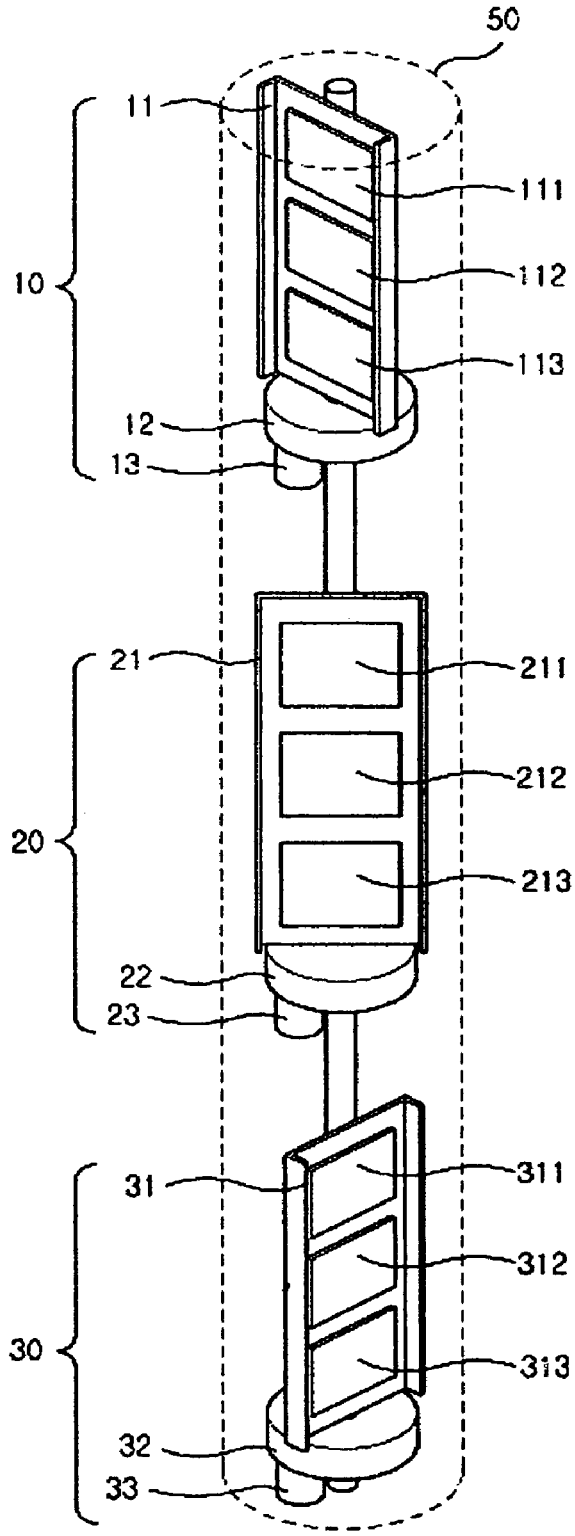
FIG. 1 is an elevational perspective view of a variable beam controlling antenna installed in a mobile communication base station according to a first embodiment.
Figure 2:
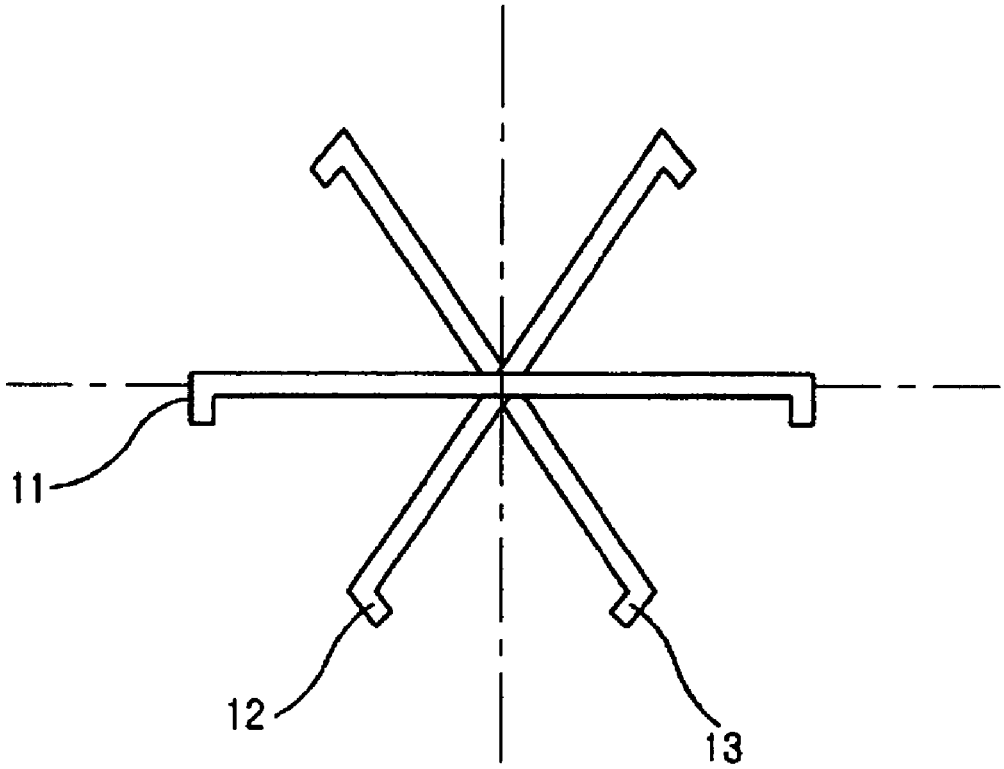
FIG. 2 is a top plan view showing an example of the rotational positions of reflectors in the antenna illustrated in FIG. 1.

FIG. 1 is an elevational perspective view of a variable beam controlling antenna installed in a mobile communication base station according to a first embodiment. FIG. 2 is a top plan view showing an example of the rotational positions of reflectors in the antenna as illustrated in FIG. 1.

Referring to FIGS. 1 and 2, an antenna for changing the horizontal beam width according to the first embodiment is comprised of a one-column antenna structure. The antenna has three separate radiator portions in a vertical orientation. That is, a first radiator portion 10, a second radiator portion 20, and a third radiator portion 20 are separately configured.

Each radiator portion is configured to have a reflector with antenna devices including at least one radiator arranged therein in order to receive and transmit radio signals for mobile communications. As in the example illustrated in FIG. 1, the first radiator portion 10 is provided with a first reflector 11 including a first, second and third reflector 111, 112 and 113. The second radiator portion 20 is provided with a second reflector 21 including a fourth, fifth and sixth reflector 211, 212 and 213. The third radiator portion 30 is provided with a third reflector 31 including a seventh, eighth and ninth reflector 311, 312 and 313.

In accordance with the first embodiment, the first, second and third reflectors 11, 21 and 31 are configured to rotate upon the same rotational center as in the first, second and third radiator portions 10, 20 and 30. Alternatively, the reflectors can be configured to rotate upon different rotational centers out of the common rotational center.

A first, second and third force generator 13, 23 and 33 are provided to generate rotational force to the first, second and third reflectors 11, 21, and 31 in response to an external control signal.

A first, second and third force transfer portions 12, 22 and 32 are provided to transfer a rotational force generated from the first, second and third force generators 13, 23 and 33 to the first, second and third reflectors 11, 21 and 31. The first, second and third force transfer portions 12, 22 and 32 are configured to include a plurality of gears, a shaft and a bearing.

The external control signal that controls the operation of the first, second and third force generators 13, 23 and 33 can be provided by hard wiring or wirelessly from a source that is near to the antenna, such as a base station body (not shown) or a base station controller.

When a tall building is constructed or a new base station is built in an adjacent, or when radiation in an environment changes due to a temporary increase in the number of calls, for optimum cell planning, an optimized control signal is applied to the first, second and third force generators 13, 23 and 33 to rotate the first, second and third reflectors 11, 21 and 31 to an optimum rotational degree.

In the antenna having the above-described configuration, the first, second and third radiator portions 10, 20 and 30 are contained in one radome 50 that serves as a housing, which is sealed with upper and lower caps (not shown). Thus, the radome 50 makes the first, second and third radiator portions 10, 20 and 30 collectively appear as a single antenna.

Figure 3:
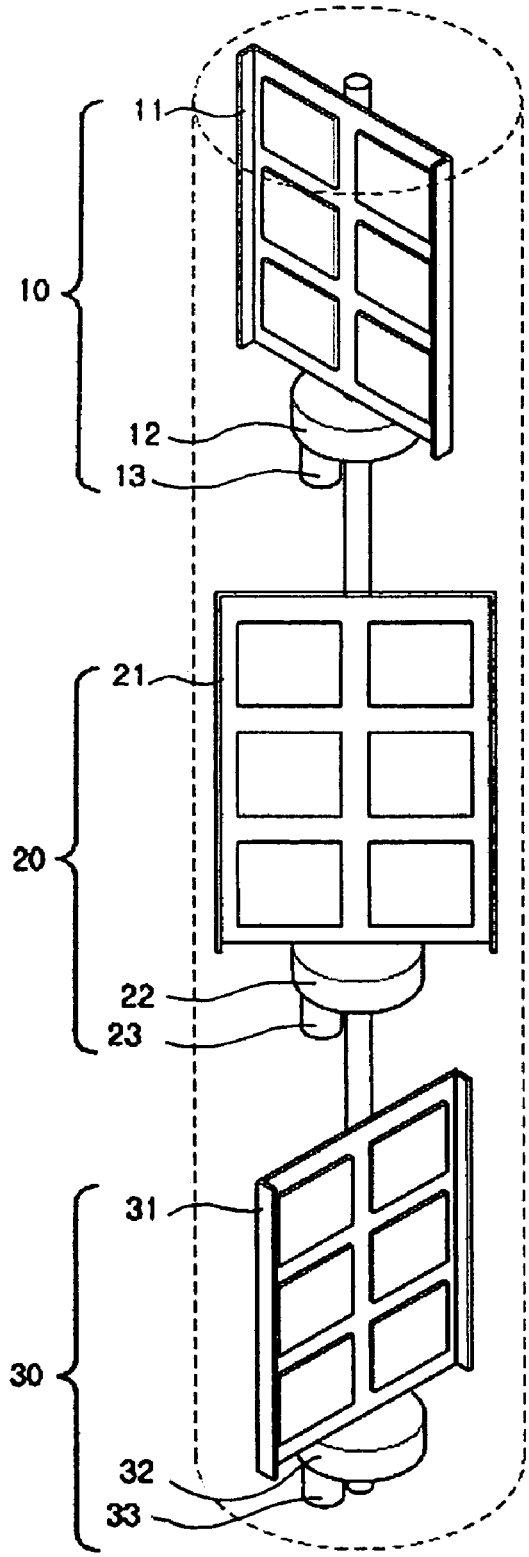
FIG. 3 is an elevational perspective view of a variable beam controlling antenna installed in a mobile communication base station according to another embodiment.

FIG. 3 is an elevational perspective schematic view of a variable beam controlling antenna installed in a mobile communication base station according to a second embodiment of the present invention. The antenna is identical to the antenna illustrated in FIG. 1 in configuration and principle. While the radiators in the first, second and third reflectors 11, 21 and 31 have a one-column array structure, as shown in FIG. 1, the radiators or the second embodiment are arranged in two columns as illustrated in FIG. 3.

Figure 4:
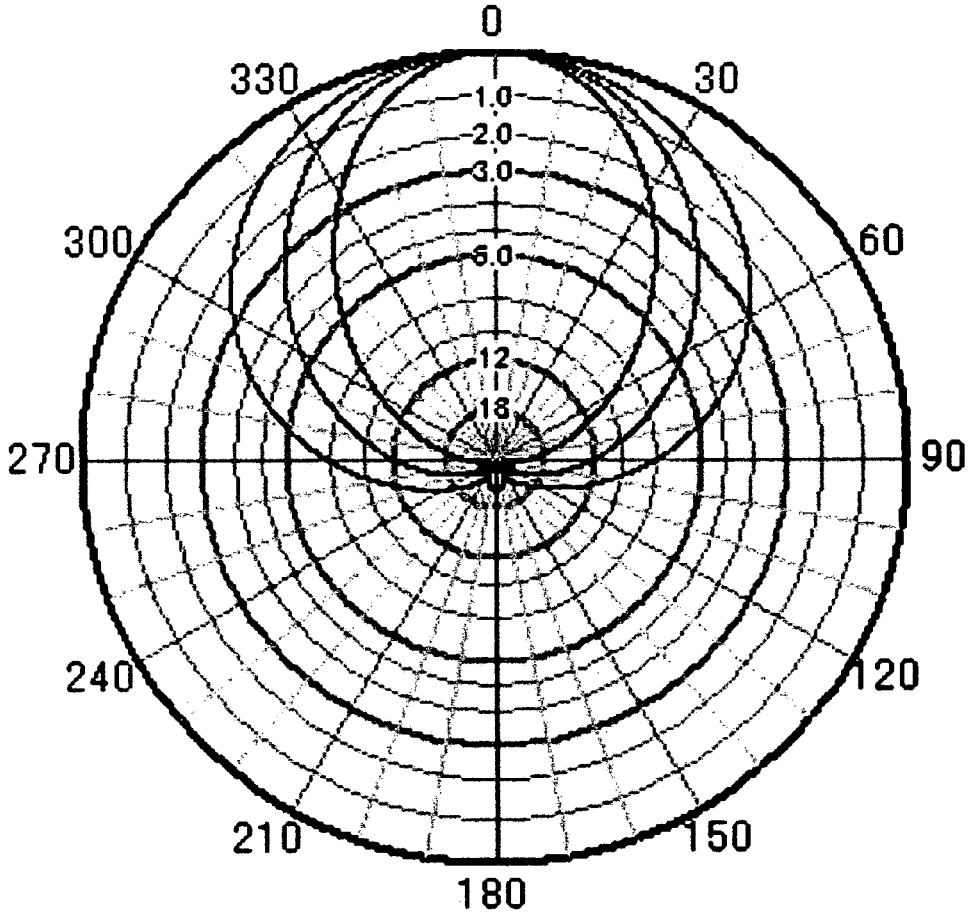
FIG. 4 is an exemplary view of the results of a beam width control simulation of the antenna illustrated in FIG. 1.
Figure 5:
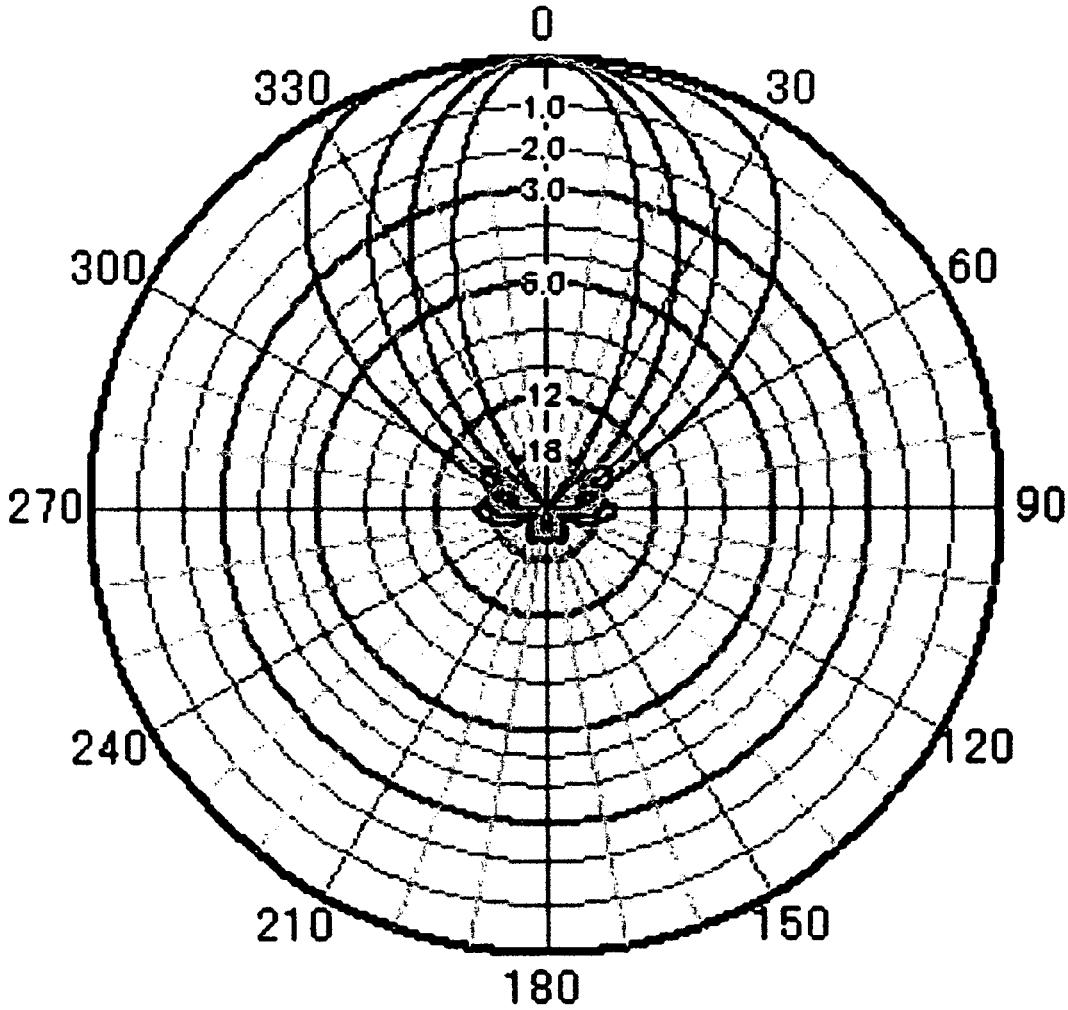
FIG. 5 is an exemplary view of the results of a beam width control simulation of the antenna illustrated in FIG. 3.

FIG. 4 is an exemplary view of the results of a beam width control simulation of the antenna illustrated in FIG. 1 and FIG. 5 is an exemplary view of the results of a beam width control simulation of the antenna illustrated in FIG. 3. The variations of a horizontal beam width according to the rotational angles (directions) of the first and third reflectors 11 and 31, with respect to the second reflector 21 in the middle, are shown in FIGS. 4 and 5. The simulation results shown in FIGS. 4 and 5 are summarized in Table 1 and Table 2 below.

TABLE 1

| | Beam Width | | |
|---|---|---|---|
| | 65 | 90 | 120 |
| Radiator Direction | 0 | ±41 | ±54 |

TABLE 2

| | Beam Width | | | |
|---|---|---|---|---|
| | 33 | 45 | 65 | 90 |
| Radiator Direction | 0 | ±24 | ±30 | ±36 |

The variable beam controlling antenna for a mobile communication base station according to the first and second embodiments of the present invention can variably control the horizontal beam width. The horizontal beams width is controlled by the by appropriate control of the mutual rotational directions of the first, second and third radiator portions 10, 20 and 30 which are arranged vertically in one column, and can form a beam with less ripples in the forward direction of the antenna.

As described above, the first, second and third radiator portions 10, 20 and 30 are provided with their respective first, second and third 15 force generators 13, 23 and 33 to rotate the first, second and third reflectors 11, 21 and 31. In an alternate mechanization the first, second and third reflectors 11, 21 and 31 can be partially or wholly rotated by use of a single force generator and a force transfer portion with a plurality of gears and a gear shaft for transferring force generated from the force generator to the first, second and third radiator portions 10, 20 or 30.

Figure 6A:
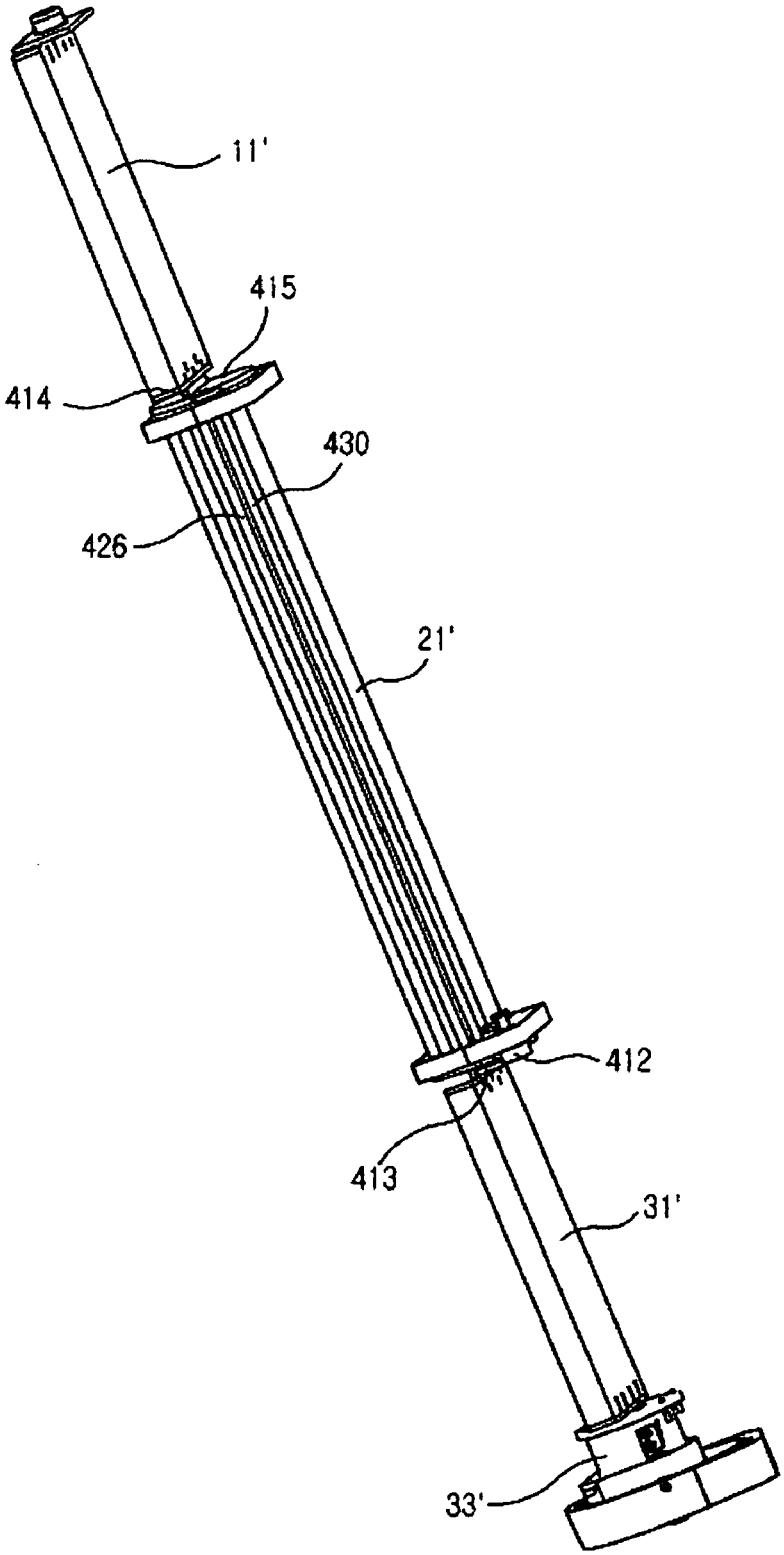
FIGS. 6A, 6B and 6C are perspective views illustrating a portion of a variable beam controlling antenna in a mobile communication base station according to a third embodiment.
Figure 6B:
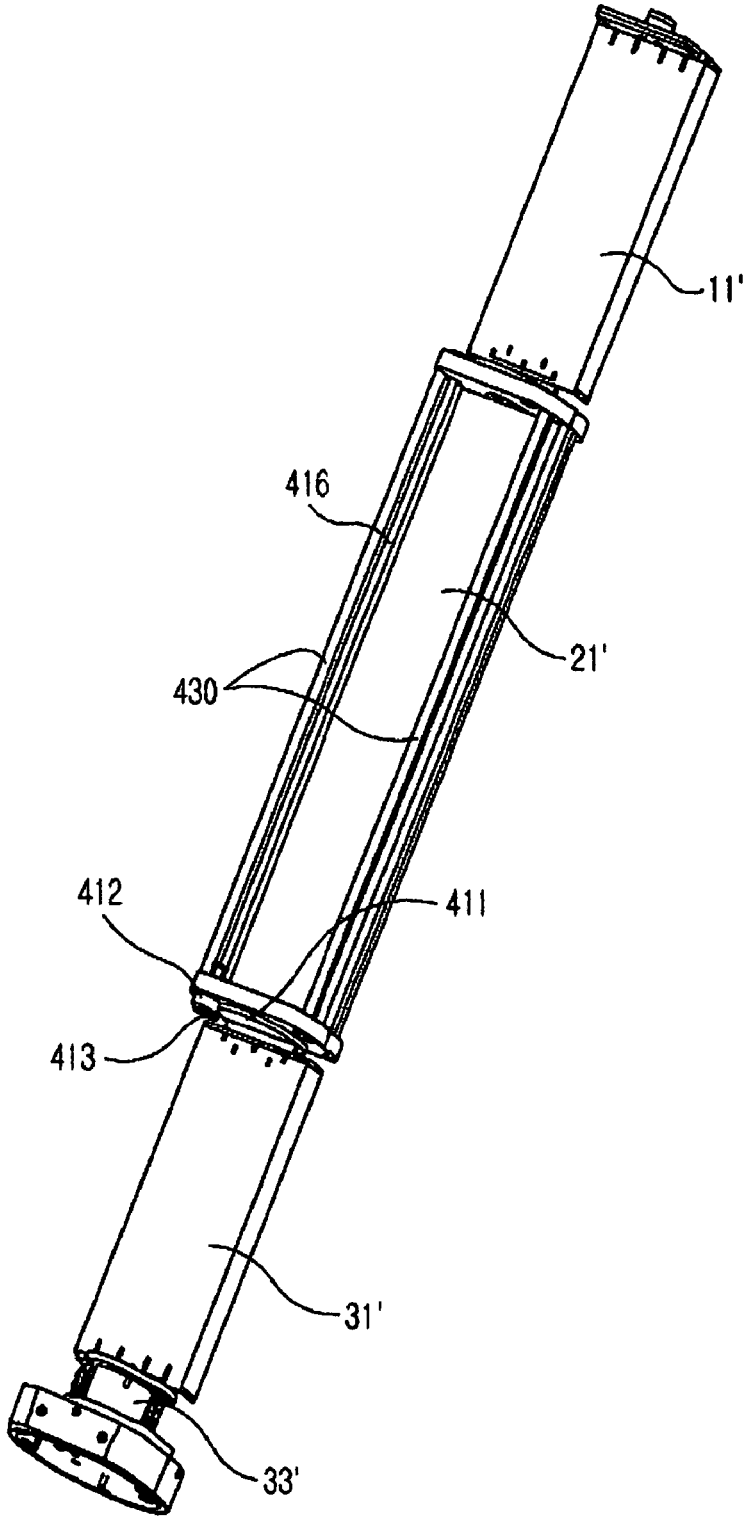
Figure 6C:
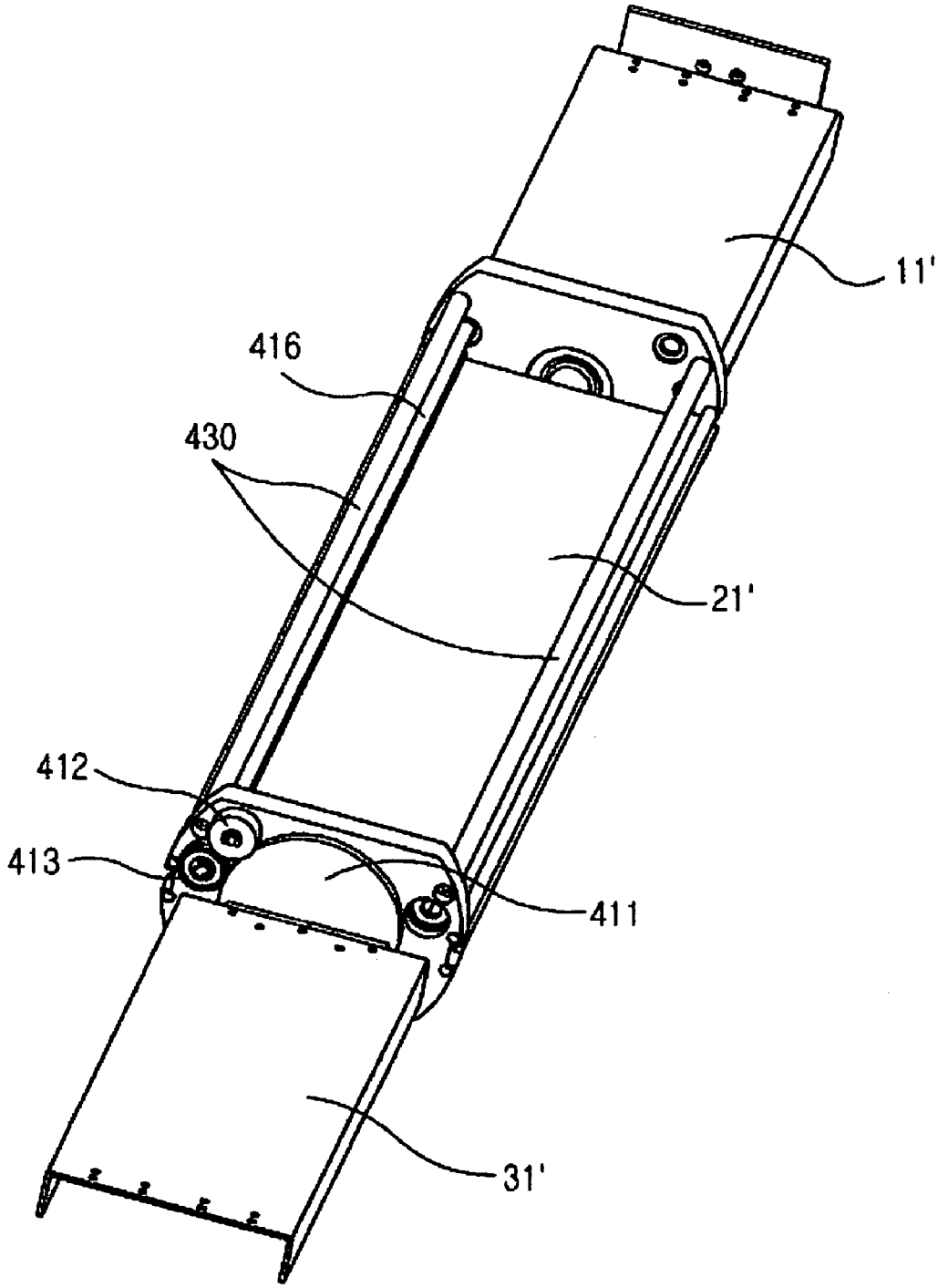
Figure 7:
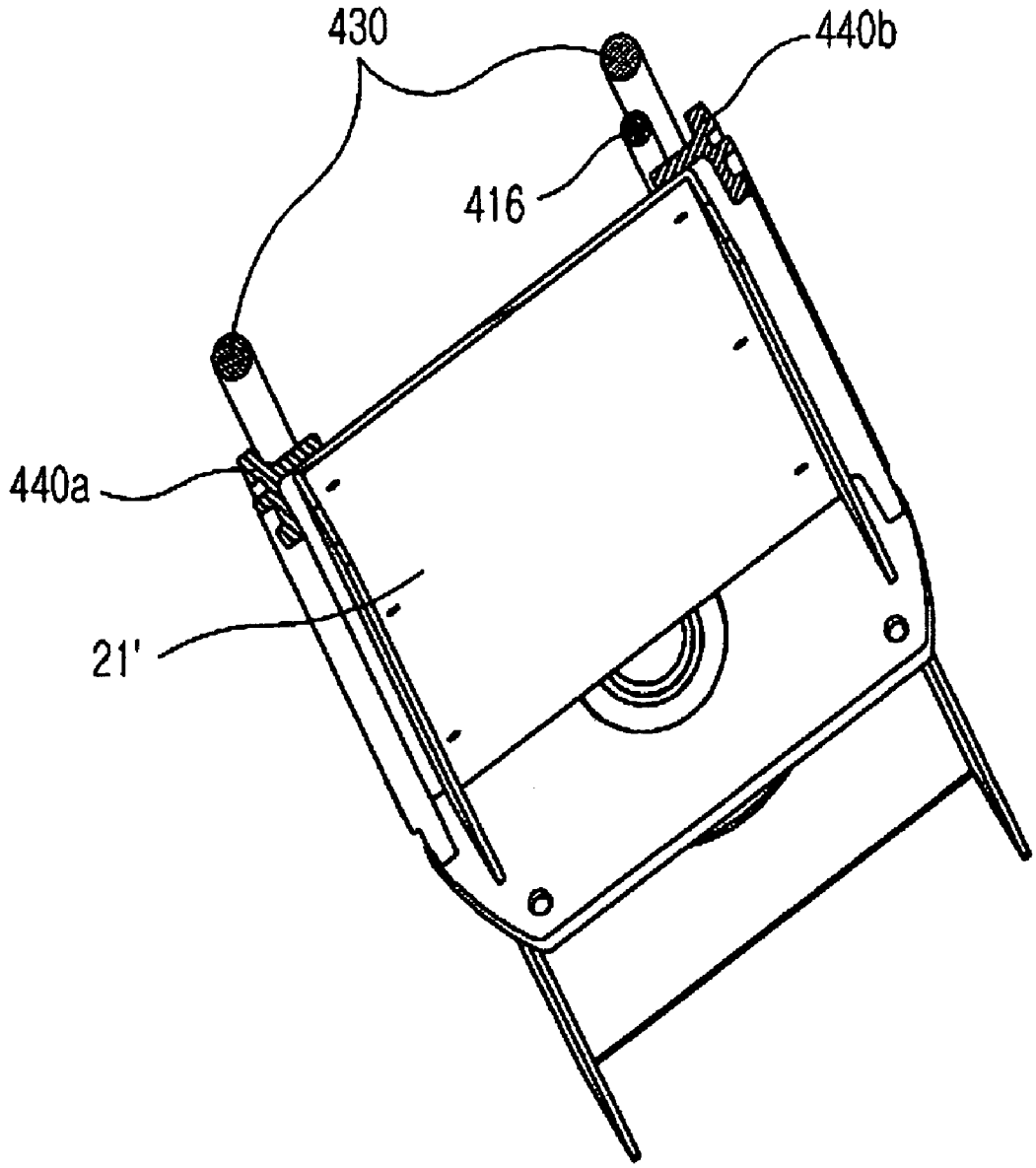
FIG. 7 is a partially enlarged perspective view showing the bottom of a second radiator of the antenna illustrated in FIGS. 6A, 6B and 6C.

FIGS. 6A, 6B and 6C are perspective views illustrating a portion of a variable beam controlling antenna that is located in a mobile communication base station according to a third embodiment of the present invention. Specifically, FIG. 6A illustrates the rear portion of the antenna, as viewed from the upper left. FIG. 6B illustrates the rear portion of the antenna, as viewed from the lower right. FIG. 6C illustrates the rear portion of the antenna, as viewed from a lower height than from the upper left. The force generator is not shown in FIG. 6C. FIG. 7 is a partially enlarged perspective view showing the bottom of a second radiator of the antenna, as illustrated in FIGS. 6A, 6B and 6C.

Referring to FIG. 6A to FIG. 7, the antennas shown are similar to the antennas illustrated in FIGS. 1 and 3. However, the antennas have three vertical separate radiator portions and the first, second and third reflectors 11', 21' and 31' are vertically arranged along the same rotational center. As in the first embodiment, the first, second and third reflectors 11', 21' and 31' do not necessarily have the same rotational center.

The second reflector 21' is fixed to a radome (not shown) by fixing guides 440*a* and 440*b*, as shown in FIG. 7, and the first and third reflectors 11' and 31' are rotatably installed.

As shown in FIG. 6B, a force generator 33' including a motor is installed under the third reflector 31', and the rotational shaft of the motor is connected to the third reflector 31' by a gear so that the third reflector 31' is rotated along with the rotation of the motor. In this structure, the first reflector 11' is configured to rotate in the opposite direction, with conjunction of the rotation of the third reflector 31' through a force transfer portion having a plurality of gears and a gear shaft. The first to fifth gears 411 to 415 and a gear shaft 416 collectively form the force transfer portion.

The first gear 411 is attached to an upper end portion of the third reflector 31' so that it can rotate along with the rotation of the third reflector 31'. The second gear 412 is installed to rotate in engagement with the first gear 411, and the third gear 413 is installed to rotate in engagement with the second gear 412. The fifth gear 415 is attached to a lower end portion of the first reflector 11' so that the first reflector 11' can rotate along with the rotation of the fifth gear 415. The fourth gear 414 is installed to rotate in engagement with the fifth gear 415. The third gear 413 is connected to the fourth gear 414 by the gear shaft 416. When the third gear 413 rotates, the gear shaft 416 rotates, thereby in turn 10 rotating the fourth gear 414.

When the third reflector 31' rotates by driving the force generator 33', the first to fifth gears 411 to 415 rotate in sequence. Consequently, the first reflector 11' rotates in the opposite direction to the rotation of the third reflector 31'.

According to the third embodiment of the present invention, the first and third reflectors 11' and 31' interwork with each other with respect to the second reflector 21' and thus rotate in the opposite directions. Hence, the horizontal beam width can be variably controlled. Meanwhile, in FIG. 6A to FIG. 7, support rods 430 are provided at appropriate positions to firmly support the second reflector 21'.

Figure 8A:
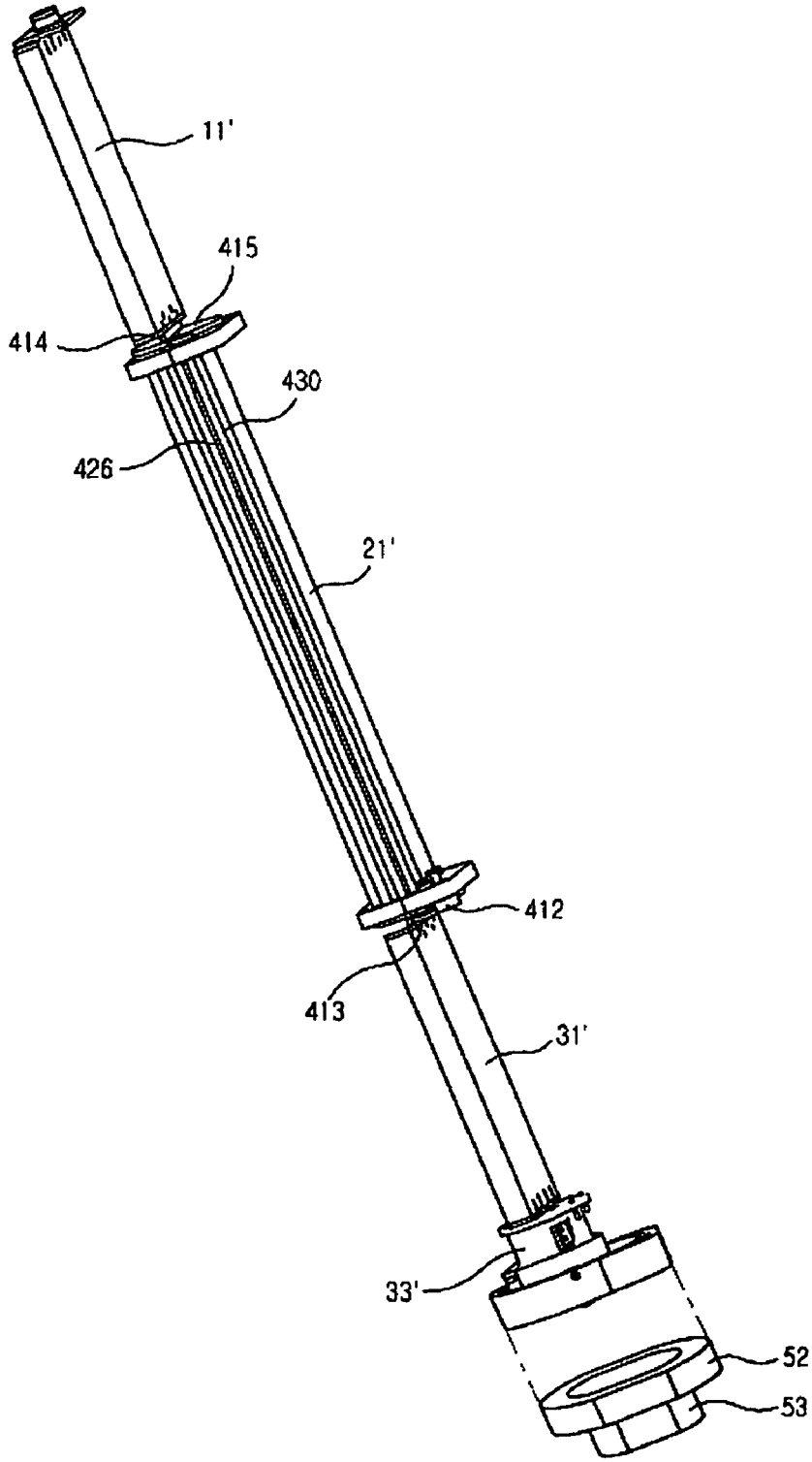
FIGS. 8A and 8B are views of an antenna modified from the antenna illustrated in FIGS. 6A and 6B.
Figure 8B:
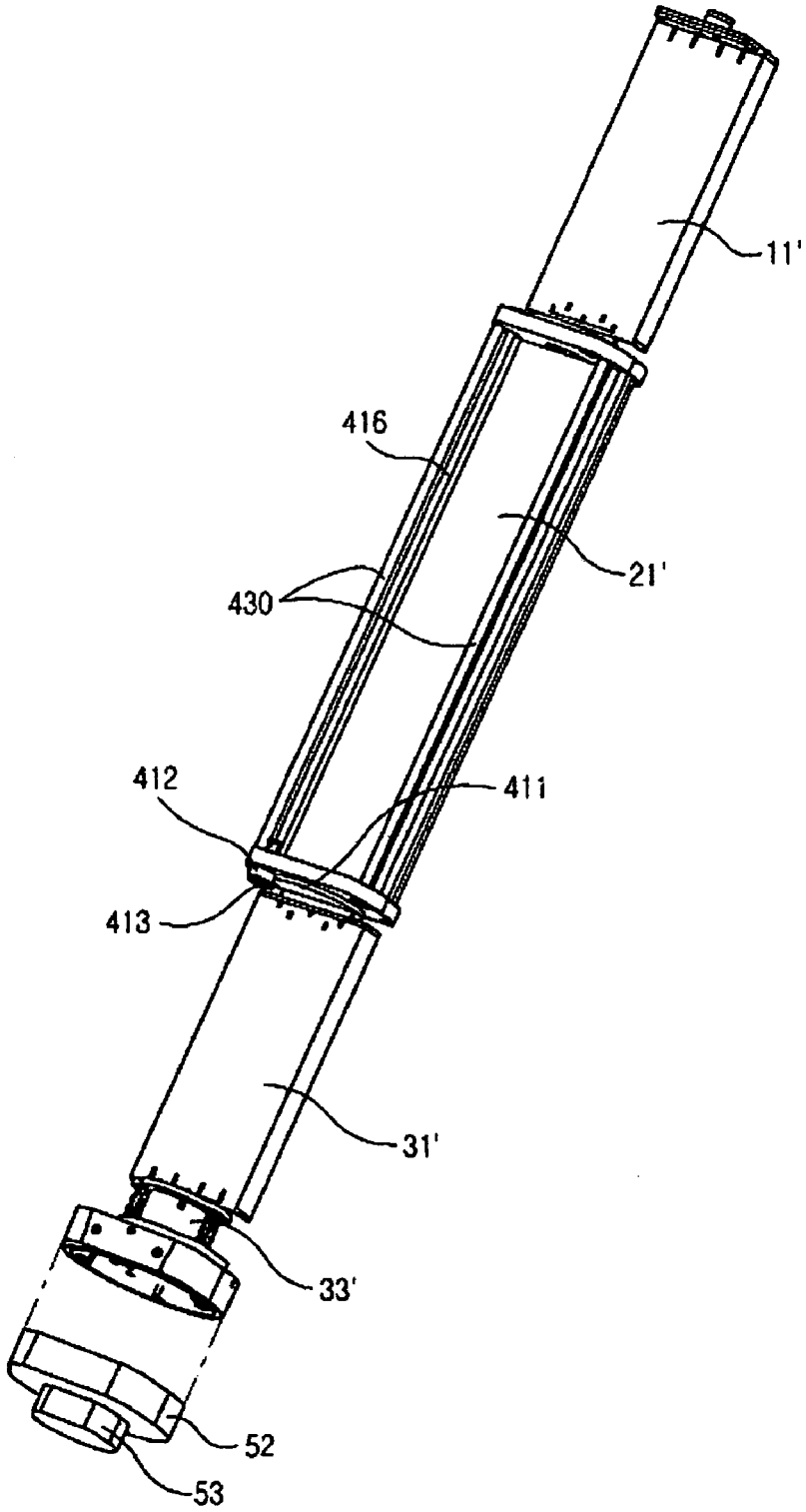

FIGS. 8A and 8B are views of an antenna modified from the antenna illustrated in FIGS. 6A and 6B. FIG. 8A illustrates the rear portion of an antenna, as viewed from the upper left, and FIG. 8B illustrates the rear important portion of the antenna, as viewed from the lower right. Referring to FIGS. 8*a* and 8B, the antenna shown is almost the same in configuration as the antenna of the third embodiment. This antenna has a second force generator 53 with a motor (not shown) for rotating the first, second and third reflectors 11', 21' and 31' to control the horizontal steering, as well as the horizontal beam width, and a second force transfer portion 52.

The second force generator 53 operates in response to an external control signal. The generator 53 is provided with a motor for rotating the entire first, second and third reflectors 11', 21' and 31'. The second force transfer portion 52 is connected to a lower portion of a fixed frame of the force generator 33'. Thus, the rotational shaft of the motor in the second force generator 53 is connected to the fixed frame of the force generator 33' by a gear, so that the fixed frame is rotated along with the rotation of the motor. Hence, the rotation of the fixed frame in the force generator 33' leads to the rotation of the entire first, second and third reflectors 11', 21' and 31'.

While it has been described that the second reflector 21' is fixed to the radome (not shown) by the fixing guides 440*a* and 440*b*, as shown in FIGS. 6A-6C, and FIG. 7, the second reflector 21' is installed rotatably and thus not fixed to a radome in the antenna configuration shown in FIGS. 8A and 8B. Thus in the modified antenna, the first, second and third reflectors 11', 21' and 31' are wholly rotated so that the horizontal steering of the antenna can be variably controlled.

While the invention has been shown and described with reference to certain preferred embodiments thereof, it will be understood by those skilled in the art that various changes in form and details may be made therein without departing from the spirit and scope of the invention. For example, while it has been described that the antenna according to the embodiments of the present invention has three separate radiator portions, it can be further contemplated as other embodiments that have two, four or more radiator portions. The radiator configuration can be designed appropriately taking into account vertical side lobe characteristics, implementation complexity, and cost.

In addition, while the radiator portions are configured to rotate by use of a force generator and a force transfer portion, that is, by a mechanical horizontal beam width changing method, an electrical horizontal beam width changing method can also be adopted, in which the horizontal beam width of the antenna is controlled by controlling the phases of signals transmitted from the radiators of the radiator portions, similar to an electrical horizontal steering method that controls horizontal steering.

As described above, the variable beam controlling antenna for a mobile communication base station according to the present invention can be fabricated at a low cost. The invention allows for easy automatic optimization, which is required for a mobile communication wireless network because it is configured to be a one-column antenna capable of controlling a horizontal beam width. Although conventionally, many kinds of antennas with different beam widths are needed for base station sectors, the single antenna easily changes its beam width in the present invention. Furthermore, this one-column antenna can control horizontal steering as well as the horizontal beam width.

Therefore, various changes in form and details may be made therein without departing from the spirit and scope of the invention as defined by the appended claims.

The invention claimed is:

1. A variable beam controlling antenna for a mobile communication base station comprising:

a) at least two radiator portions arranged vertically with each radiator portion having a reflector with at least one radiator, wherein the radiators are arrayed in one column or two columns in the reflectors, and wherein the reflectors have the same rotational center and are installed within a radome that serves as a housing and is sealed with an upper and lower cap, b) at least one force generator for providing rotational force in response to an external control signal, and c) a force transfer means for transferring the rotational force generated by at least one of the force generators to at least one reflector, thus rotating the at least one reflector.

2. The variable beam controlling antenna as specified in claim 1 further comprising:

a) a second force generator for providing rotational force to rotate the entire radiator portions, and b) a second force transfer portion for transferring the rotational force generated from the second force generator to the radiators.

3. A variable beam controlling antenna for a mobile communication base station comprising:

a) a first, second and third two radiator portions arranged in sequence vertically with each portion having a reflector with at least one radiator, b) a force generator for providing rotational force to rotate the reflector of the third radiator portion in response to an external control signal, and c) a force transfer means for rotating the reflector of the first radiator portion in the opposite direction to the rotational direction of the reflector of the third radiator portion along with the rotation of the reflector of the third radiator portion.

4. A variable beam controlling antenna for a mobile communication base station comprising:

a) a first, second and third radiator portions arranged in sequence vertically with each portion having a reflector with at least one radiator, wherein the radiators are arrayed in one column or two columns in the reflectors, and the reflectors are installed within a radome that serves as a housing that is sealed with an upper and lower cap, b) a force generator for providing rotational force to rotate the reflector of the third radiator portion in response to an external control signal, c) a force transfer means for rotating the reflector of the first radiator portion in the opposite direction to the rotational direction of the reflector of the third radiator portion alone with the rotation of the reflector of the third radiator portion, wherein the force generator is further comprised of:

(1) a second force generator for providing rotational force to rotate the entire radiator portions, force generator and force transfer portion, and (2) a second force transfer portion for transferring the rotational force generated from the second force generator to at least the force transfer portion, thus rotating the entire radiator portions, force generator, and force transfer portion, wherein the force transfer portion is comprised of:

(a) a second gear for rotating along with the rotation of the first gear, (b) a third gear for rotating along with the rotation of the second gear, (c) a gear shaft for rotating along with the rotation of the third gear, (d) a fourth gear for rotating along with the rotation of the gear shaft, and (e) a fifth gear attached to an end portion of the reflector of the first radiator portion, for rotating along with the rotation of the fourth gear, thus rotating the reflector of the first radiator portion.

* * * * *